United States Patent [19]

Evans

[11] 4,108,529

[45] Aug. 22, 1978

[54] ELECTRICAL FEEDTHROUGH DEVICES

[75] Inventor: David Roger Evans, Petersfield, England

[73] Assignee: Sealectro Corporation, Mamaroneck, N.Y.

[21] Appl. No.: 740,092

[22] Filed: Nov. 9, 1976

[30] Foreign Application Priority Data

Nov. 14, 1975 [GB] United Kingdom ..... 47070/75

[51] Int. Cl.[2] ..... H01R 17/04; H01B 17/26

[52] U.S. Cl. ..... 339/177 R; 174/152 R; 339/94 C

[58] Field of Search ..... 339/177 R, 177 E, 94 R, 339/94 A, 94 C, 94 M, 60 C, 60 R, 60 M, 59 R, 59 M, 63 R, 63 M; 174/75 C, 88 C, 152 R

[56] References Cited

U.S. PATENT DOCUMENTS

| | | | |
|---|---|---|---|
| 2,337,800 | 12/1943 | Cassen | 339/94 C |
| 2,549,647 | 4/1951 | Turenne | 339/60 C |
| 2,619,515 | 11/1952 | Doane | 339/63 R |
| 2,684,398 | 7/1954 | Strunk | 339/94 C |
| 2,761,111 | 8/1956 | Klostermann | 339/94 M |
| 2,860,316 | 11/1958 | Watters et al. | 339/94 C |
| 3,059,208 | 10/1962 | Concelman | 339/177 R |
| 3,671,926 | 6/1972 | Nepovim | 339/177 E |

FOREIGN PATENT DOCUMENTS

| | | | |
|---|---|---|---|
| 1,019,623 | 2/1966 | United Kingdom | 339/59 R |

*Primary Examiner*—Neil Abrams

*Attorney, Agent, or Firm*—Anthony J. Casella; Joseph A. Calvaruso

[57] ABSTRACT

An electrical feedthrough for connecting electrical components on opposite sides of a bulkhead includes a conductive sleeve, and disposed within the sleeve is a dielectric body carrying an electrical conductor extending longitudinally of the sleeve. The electrical conductor is physically spaced and electrically insulated by the dielectric body from the conductive sleeve, and a part of the dielectric body is physically deformed to effect a hermetic seal with the conductive sleeve and/or electrical conductor. In the method of assembly of the electrical feedthrough of the subject invention, a part of the dielectric body is deformed to effect the hermetic seal.

5 Claims, 8 Drawing Figures

PRIOR ART
FIG. 1B
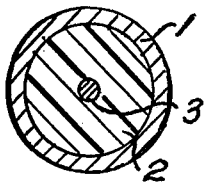
PRIOR ART
FIG. 1A
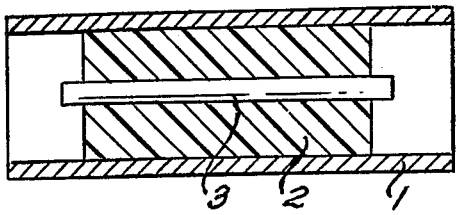
FIG. 2
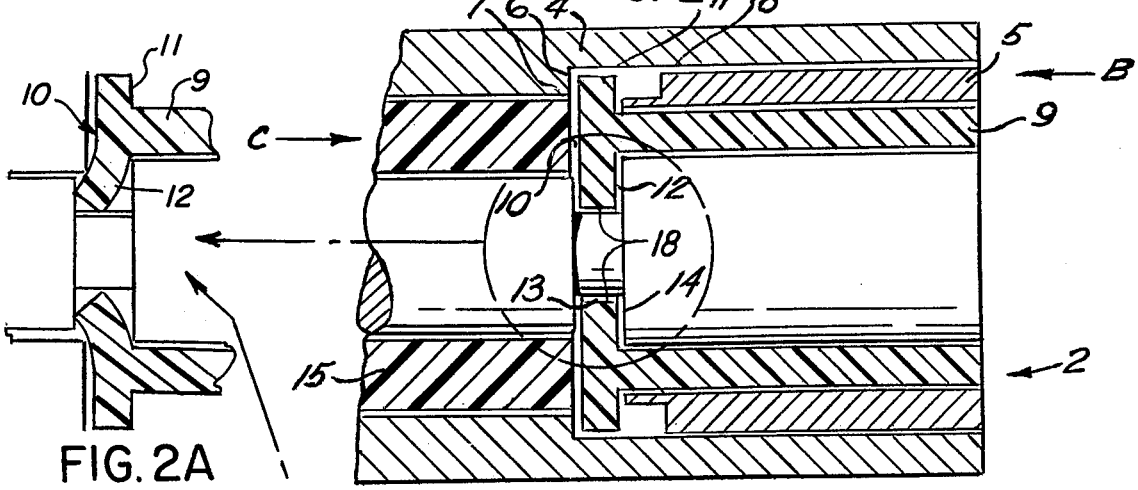
FIG. 2A
FIG. 5
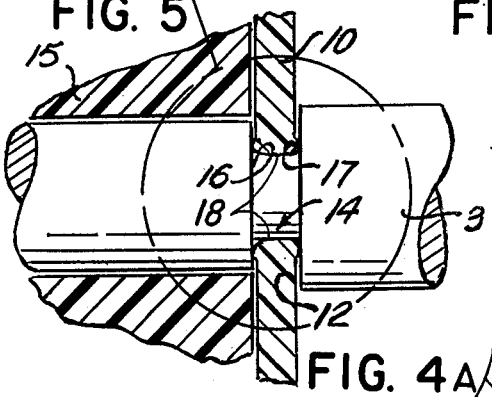
FIG. 3
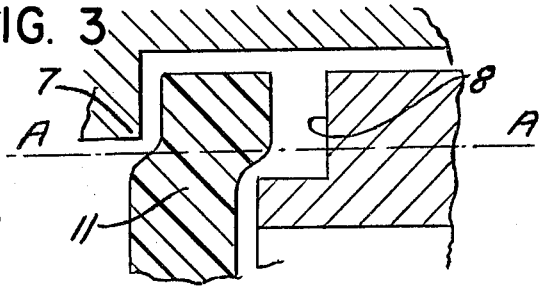
FIG. 4A
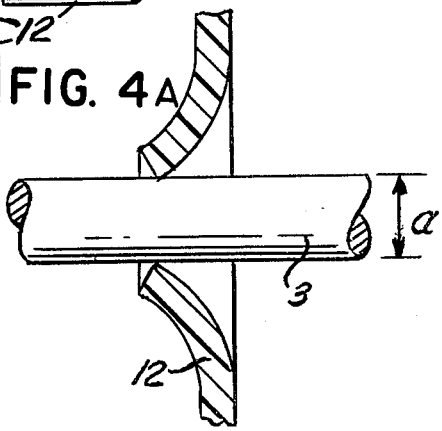
FIG. 4B
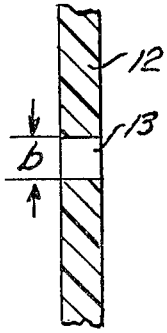

ELECTRICAL FEEDTHROUGH DEVICES

This invention relates to electrical feedthrough devices, and to electrical connectors incorporating such devices.

The invention relates more particularly, but not exclusively, to an electrical feedthrough having a conducitve sleeve, a conductor within the sleeve, and, around the conductor a dielectric body which physically spaces and electrically insulates the conductor from the sleeve.

FIGS. 1*a* and 1*b* of the accompanying drawing illustrate in longitudinal and transverse section respectively, a feedthrough which incorporates these basic features in one particular form, namely that of a coaxial feedthrough, which may be incorporated in a coaxial connector, and which has a circular cylindrical sleeve 1, and, extending axially within the sleeve an elongate conductor 3 which is fixed by means of dielectric body 2 of annular cross section. The conductor 3 may, as shown in the longitudinal section of FIG. 1*b* project beyond the two opposite ends of the dielectric body 2, for connection to appropriate complementary connecting elements, for instance to form the coaxial connector.

FIG. 1 illustrates only the basic form of the coaxial feedthrough, various adaptions and modifications being commonly made according to the particular purpose for which the feedthrough is required. For instance, the feedthrough may be suitably adapted as a bulkhead connector, for transmitting direct alternating, or other periodic voltages and currents between two transmission or other electrical devices separated by a bulkhead, or otherwise. Alternatively, the feedthrough may be adapted as a cable mounted connector for coupling one transmission cable to another, or to some electrical apparatus.

It is preferred that the dielectric body be hermetically sealed to the sleeve and the conductor, but existing techniques of preparing such hermetically sealed connectors suffer from the disadvantage that the means used to effect a hermetic seal impairs the effective transmission of alternating current and voltage. This impairment arises from the physical properties of commonly used glasses as the dielectric.

According to the present invention there is also provided an electrical feedthrough having a conductive sleeve and, disposed within the sleeve, a dielectric body carrying a conductor which is physically spaced and electrically insulated by the dielectric body from the sleeve, a part of the dielectric body being physically deformed to effect a hermetic seal with the sleeve and/or conductor.

According to the present invention there is provided a method of making an electrical feedthrough comprising disposing within a conductive sleeve, a dielectric body carrying a conductor, so that the conductor is physically spaced and electrically insulated by said dielectric body from the sleeve, and deforming a part of the dielectric body to effect a hermetic seal with the sleeve and/or the conductor.

In this context, the term hermetic seal means a differential pressure seal and is not intended in itself to be limited to any particular method of production.

The sleeve is preferably circular cylindrical, the conductor extending axially within the sleeve, and the dielectric body is preferably annular in transverse section, disposed coaxially within the sleeve, about the conductor, and provided at one end with a radially extending flange.

Where the dielectric is hermetically sealed to the sleeve, the deformation may be caused by a partial shearing of an edge region of an outwardly projecting part of the flange against an edge of a peripheral stepped portion on the inner surface of the outer part of the sleeve. This shearing may be caused by trapping the edge region, when assembling the connector, between this stepped portion of the outer part of the sleeve and a stepped portion of complementary configuration to the first-mentioned step portion, and formed on an inner part of the sleeve slidably disposed within the outer part and forcing these two stepped portions together. A shear seal is produced thereby and provides the hermetic seal mentioned above.

Where, on the other hand, the dielectric is hermetically sealed to the conductor, an inwardly projecting part of the flange may be deformed when, during assembly the conductor is inserted through a central aperture in the flange, this aperture being of smaller dimension, in the undeformed condition, than that of the conductor's cross section.

Preferably, the dielectric is hermetically sealed to both the sleeve and the conductor.

Reference will hereinafter be made to the accompanying drawings, which illustrate embodiments of the invention, and in which:

FIGS. 1*a* and 1*b* show in transverse and longitudinal cross-section respectively, the known basic features of a coaxial feedthrough;

FIG. 2 shows in longitudinal section, a feedthrough according to the invention, but wherein the deformation of the dielectric body, for the sake of clarity, is not shown;

FIG. 2*a* is an enlarged view of specific elements of the feedthrough of the subject invention;

FIG. 3 is a detailed view of part of the feedthrough of FIG. 2, at which a hermetic seal is produced by deformation;

FIGS. 4A and 4B illustrates the relative dimensions of specific elements of the feedthrough of FIG. 2A, and the manner in which a hermetic seal is achieved; and FIG. 5 is a detailed view showing how the principle of FIGS. 4A and 4B is applied to the feedthrough of FIG. 2.

The known basic form of coaxial feedthrough as shown in FIG. 1 has been described above as having a sleeve 1, a dielectric body 2 and a conductor 3, and like reference numerals will be used in the description of FIGS. 2 to 5 when indicating corresponding elements.

With reference to FIG. 2, the sleeve 1 comprises an outer cylindrical part 4 and inner cylindrical part 5 which fits coaxially within the outer part in the region of one end thereof. The outer part 4 has a stepped portion 6 on its inner surface which presents a peripheral machined edge 7, for cooperation with a peripheral step 8 machined at an inner end of the inner part 5. The dielectric body 2 comprises a tubular body 9 within the sleeve 1, with an integrally formed transverse flange 10 across its inner end. This flange 10 has an outer annular part 11 and inner annular part 12 projecting radially outwardly and inwardly, respectively of the tubular body 9. The inner annular part 12 defines a central circular aperture 13, through which the conductor 3 projects. The conductor 3 is in this embodiment formed with an annular groove 14 and, as illustrated diagrammatically in FIGS. 4A and 4B, the diameter *a* of the inner cylindrical surface of the groove 14 is greater (though this is not apparent in FIG. 2) than the initial diameter *b* of the aperture 13 prior to assembly of the device.

In another embodiment which FIGS. 4A and 4B illustrates more clearly, the conductor 3 is of uniform circular cross-section, the diameter *a* again being greater than the diameter *b* of the aperture 13.

In the fully assembled feedthrough, a further tubular body 15 of dielectric material is disposed within the sleeve 1 and abuts the flange 10 of the body 9 to complete the dielectric body 2. This further body 15 may be of the same material as the first-mentioned body 9 and serves a purpose, during assembly, of aiding the deformation of the inner part 12 of the flange as will be explained.

It will be understood that the radial separation between the sleeve parts, the dielectric bodies and the conductor are exaggerated in the various sectional views illustrating the preferred embodiment, in particular FIG. 2, merely for the purpose of ease of identification of the different parts of the feedthrough, and that these parts in fact fit snugly together to form a compact unit.

When assembling the feedthrough, the outer and inner annular parts of the flange 10 become deformed against the sleeve and the conductor, to form hermetic seals in a manner as described below.

The inner part 5 of the sleeve 1 is forced inwardly in the direction of arrow B in FIG. 2 and the outer annular part 11 is trapped between the step 8 and the stepped portion 6, and, upon being forced against the machined edge 7 is deformed by being caused partially to shear about line A—A as shown in the enlarged view of FIG. 3. An annular shear seal is thus formed between the flange 10 and the sleeve portions 4 and 5.

When the conductor 3 is inserted into the tubular body 9 in the direction of arrow B in FIG. 2, the inner annular part 12 of the flange 10 becomes deformed in a manner as illustrated in FIGS. 4A and 4B because of the relative magnitudes of the dimensions *a* and *b*. When the dielectric body 15 is then forced onto the conductor in the direction of arrow C in FIG. 2, the deformed region of the inner annular part 12 in the immediate vicinity of the conductor 3 is caused to reflex into the groove 14, where it is constrained between the two annular surfaces 16 and 17 forming the groove, and adopts the shape shown in FIG. 5 wherein the inside face 18 originally defining the aperture 13 is forced radially against the inner cylindrical surface of the groove 14 by virtue of the internal compressive stresses in the material of the flange 10 caused by the deformation. In the view of FIG. 5, only the flange part 10 of the tubular dielectric body 9 is illustrated for the sake of clarity. The seal thus produced serves also to locate the conductor correctly within the dielectric body and to inhibit relative axial displacement.

It will be appreciated that if the conductor has no groove, a satisfactory hermetic seal may still be achieved by forcing the deformed region of the inner annular part 12 to adopt a configuration in which the inside face 18 is pressed against the outer cylindrical surface of the conductor, though clearly relative axial displacement will not be inhibited to the same extent as in the embodiment shown in FIG. 5.

The dielectric body is made of a deformable material commonly employed in the manufacture of coaxial feedthroughs, such as p.t.f.e. and the geometry of the feedthrough can be such as to transmit effectively direct, alternating or other periodic voltages or currents.

The feedthrough whose construction and method of assembly is described above may be incorporated in any of a wide variety of electrical connecting assemblies, such as a coaxial connector.

The feedthrough may, for instance be fixed and hermetically sealed within some form of feedthrough housing by employing the technique which forms the subject-matter of our co-pending patent application No. 740,091, filed Nov. 9, 1976. This technique involves the deformation of an outer peripheral edge region of a peripheral flange which projects radially outwardly relative to an outer conductive sleeve of what is termed in that application a hermetic sub-assembly which may be the feedthrough described above. The flange may be formed integrally with the sleeve or may be a separate ring element, but in either case it encircles the sleeve and becomes deformed, for instance by partial shearing, against a stepped portion on an internal surface of the feedthrough housing. Where the flange is separate from the sleeve, it is also deformed against a stepped portion on the outer surface of the sleeve, and where it is integral with the sleeve it is also deformed against a stepped portion at the end of an assembly bush which is slidable within the feedthrough housing.

The embodiments of the invention, in which an exclusive property of privilege is claimed, are defined as follows:

1. An electrical feedthrough having an elongated conductive sleeve and, disposed within the sleeve a tubular body of dielectric material carrying a conductor, said conductor being physically spaced and electrically insulated by the dielectric body from the sleeve, said tubular dielectric body having a unitary radially projecting flange that projects inwardly of said tubular body and has an inner edge region defining an aperture, said inner edge region being disposed against said conductor and being radially compressibly stressed and deformed so as to exert radial and longitudinal pressure on the surface of the conductor to form a hermetic seal, said dielectric body further having a unitary radially projecting flange that projects outwardly of the tubular body said outwardly projecting flange having an outer region which is physically deformed by having been partially sheared against an edge provided by a first circumferential step formed on the inner surface of an outer part of the sleeve, said partially sheared outer region lying between said first circumferential step portion and a second circumferential step of complimentary shape to said first step portion, said second step being provided on an inner part of the sleeve disposed within said outer part of the sleeve, whereby a hermetic seal with the sleeve is formed, said second step including an outwardly facing circumferential surface located radially inwardly of said edge on said first step portion.

2. An electrical feedthrough according to claim 1 wherein the sleeve is circular cylindrical, the conductor extends axially within the sleeve, and the dielectric body is annular in transverse section and is disposed coaxially within the sleeve, about the conductor.

3. An electrical feedthrough according to claim 1 wherein the radially projecting flange is provided at one end of the tubular dielectric body.

4. An electrical feedthrough according to claim 1 wherein the conductor includes a peripheral groove, and the inner edge region of said inwardly projecting unitary flange is disposed in said peripheral groove.

5. An electrical feedthrough according to claim 1 wherein said inner part of the sleeve is slidably disposed within the outer part of the sleeve.

* * * *